US011313548B2

(12) United States Patent
Lu et al.

(10) Patent No.: US 11,313,548 B2
(45) Date of Patent: Apr. 26, 2022

(54) PROTECTION SYSTEM FOR LAMP

(71) Applicant: Xiamen PVTECH Co., Ltd., Fujian (CN)

(72) Inventors: Fuxing Lu, Fujian (CN); Rongtu Liu, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

(21) Appl. No.: 16/882,549

(22) Filed: May 25, 2020

(65) Prior Publication Data

US 2021/0254819 A1 Aug. 19, 2021

(30) Foreign Application Priority Data

Feb. 14, 2020 (CN) ..... 202010093509.0

(51) Int. Cl.
*F21V 25/10* (2006.01)
*F21V 23/00* (2015.01)

(52) U.S. Cl.
CPC ..... *F21V 25/10* (2013.01); *F21V 23/004* (2013.01)

(58) Field of Classification Search
CPC ... F21V 23/004; F21V 25/10; H01H 85/0241; H01H 83/10; H01C 7/10; H01C 7/12; H01C 7/126
See application file for complete search history.

(56) References Cited

U.S. PATENT DOCUMENTS

| | | | | |
|---|---|---|---|---|
| 6,430,017 | B1 * | 8/2002 | Finlay, Sr. | H02H 9/042 361/104 |
| 8,310,800 | B1 * | 11/2012 | Williams | H01C 7/12 361/131 |
| 9,761,356 | B2 * | 9/2017 | Hsu | H01C 1/144 |
| 10,320,181 | B1 * | 6/2019 | Yang | H02H 9/041 |
| 10,895,352 | B1 * | 1/2021 | Lu | H05B 45/38 |
| 2002/0089420 | A1 * | 7/2002 | Martineau | F21V 5/04 340/463 |
| 2008/0129440 | A1 * | 6/2008 | Ho | H01C 1/08 337/5 |
| 2014/0092514 | A1 * | 4/2014 | Chen | H01C 7/12 361/118 |
| 2014/0285941 | A1 * | 9/2014 | Xu | H01C 7/126 361/127 |
| 2016/0027603 | A1 * | 1/2016 | Satou | H01C 7/10 338/21 |
| 2016/0234909 | A1 * | 8/2016 | Park | F21V 23/06 |
| 2016/0359312 | A1 * | 12/2016 | Chen | H02H 3/04 |
| 2017/0138580 | A1 * | 5/2017 | Wen | F21V 23/06 |
| 2018/0049291 | A1 * | 2/2018 | Xu | H05B 47/11 |
| 2018/0102640 | A1 * | 4/2018 | Crevenat | H01H 83/10 |
| 2019/0376667 | A1 * | 12/2019 | Coffy | F21V 19/003 |

* cited by examiner

*Primary Examiner* — Zheng Song
(74) *Attorney, Agent, or Firm* — Winston Hsu

(57) ABSTRACT

A protection system for a lamp is provided. One or more control circuit boards and one or more thermal devices are disposed in the lamp. The control circuit board has an electrical circuit. The thermal device is disposed on the control circuit board and connected to the electrical circuit. The thermal device is attached to one or more thermal fuses with a binding member. Accordingly, the safety of the driving power supply can be increased. Moreover, the thermal fuse not only provides protection for the inputs of the driving power supply, but also provides protection for other main or branch circuits.

3 Claims, 2 Drawing Sheets

PROTECTION SYSTEM FOR LAMP

CROSS REFERENCE TO RELATED APPLICATION

This application claims the benefit of priority to China Patent Application No. 202010093509.0, filed 2020 Feb. 14, which is included herein by reference in its entirety.

BACKGROUND OF THE INVENTION

1. Field of the Invention

The present invention relates to a lamp, in particular to a protection system for a lamp.

2. Description of the Prior Art

For existing tube lamps, sometimes the contacts of the lamp bases may be oxidized inevitably to cause poor contacts between the contacts of the lamp bases and the copper pins of the lamp, thereby causing the improper ignition arcing between the contacts of the lamp bases and the copper pins of the lamp. The improper ignition arcing will lead the excessive temperature on the contacts of the lamp bases as well as on the copper pins of the lamp, thereby leading safety hazards when the lamps are in use. A common solution for this situation is to have a thermal fuse serially connected on each of the copper pins. Therefore, when the lamp has an improper ignition arcing to make the copper pins have a high temperature, the thermal fuses may be blown rapidly for achieving the protection function for the lamp. However, in some conditions, overheating may occur in other parts of the lamp due to internal or external factors, thereby causing thermal runaway and safety hazards during the operation of the lamps. In view of these, the applicant provides a new use of the thermal fuse.

How to use the thermal fuse to increase the safety of the lamp during operation is an issue to be considered.

SUMMARY OF THE INVENTION

In view of these, an embodiment of the present invention provides a protection system for a light tube. The protection system comprises a circuit board, at least one thermal electronic component, and a thermal fuse. The circuit board has an electrical circuit and is disposed in the lamp. The thermal electronic component is electrically connected to the electrical circuit of the circuit board. The thermal fuse is closely attached to the thermal electronic component, and the thermal fuse is fixed on the thermal electronic component with a binding member. The thermal fuse is electrically connected to the electrical circuit to ensure that the thermal fuse is capable of being blown timely to make the electrical circuit disconnected after the temperature of the thermal electronic component raises to a blown threshold value of the thermal fuse.

According to one embodiment for the protection system, the protection system comprises a plurality of the thermal fuses disposed on the circuit and serially connected to the electrical circuit, and the thermal fuses are attached to the thermal electronic component.

According to one embodiment for the protection system, the binding member is made of phenolic resins, urea-formaldehyde resins, polyvinyl acetate resins, polyethylene-vinyl acetate resins, polyacrylic resins, polyurethane, or hot-melt adhesive.

According to one embodiment for the protection system, the thermal electronic component is a varistor, a coil, or a transformer.

According to one or more embodiments of the present invention, the protection system has following features. The thermal fuse is attached to the thermal electronic component, thereby increasing the safety of the driving power supply. Moreover, the thermal fuse not only provides protection for the inputs of the driving power supply, but also provides protection for other main or branch circuits.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
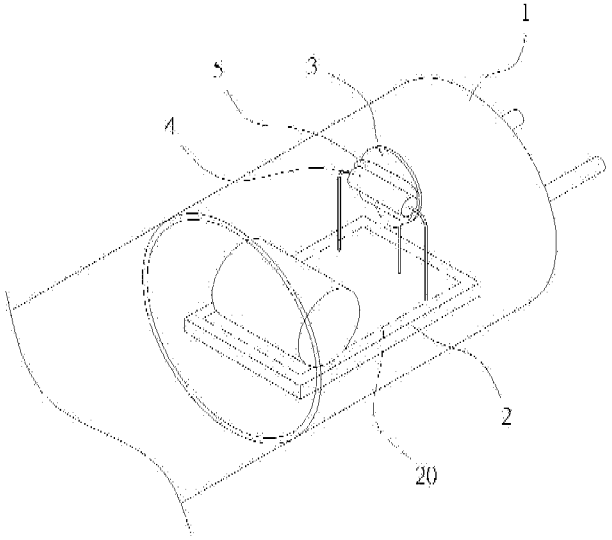
FIG. 1 illustrates a schematic perspective view showing one overheating-protection device according to one embodiment of the present invention.

The detailed description of the technical content, structural features, and the objects and effects of the technical solutions will be described in detail below with reference to the specific embodiments and the accompanying drawings.

By the application of the voltage impedance signal recognition device in the detection module, the voltage input from the mains power supply or the electronic ballast can be recognized, thereby simplifying the driving circuit as well as reducing space occupation for the circuit board and manufacturing costs. It is also possible to perform leakage test to avoid electrocution due to accidental touch by the user. Please refer to FIGS. 1 and 2, which illustrate schematic perspective views respectively showing one overheating-protection device and several overheating-protection devices according to embodiments of the present invention.

The present invention discloses a protection system for the lamp. At least one control circuit board 2 and at least one thermal device 3 are disposed in the lamp 1. The control circuit board 2 has an electrical circuit 20, and the thermal device 3 is disposed on the control circuit board 2 and connected to the electrical circuit 20. A thermal fuse 4 is attached to the thermal device 3 with a binding member 5. The binding member 5 is disposed between the thermal fuse 4 and the thermal device 3 so as to fix the thermal fuse 4 on the thermal device 3. The binding member 4 may be made of phenolic resins, urea-formaldehyde resins, polyvinyl acetate resins, polyethylene-vinyl acetate resins, polyacrylic resins, polyurethane, or hot-melt adhesive. The thermal device 3 may be a varistor, a coil, or a transformer.

In FIG. 1, it can be seen that the thermal device 3 on the control circuit board 2 is a varistor for example, the thermal fuse 4 is firstly attached to the thermal device 3, and then the thermal fuse 4 is fixed on the thermal device 3 by using the binding member 5. When the thermal device 3 on the control circuit board 2 is abnormally warmed up due to the increase of the resistance of the thermal device 3 caused by the abnormal operation of the electrical circuit 20, since the operating principle of the thermal fuse 4 is that, when the current is excessive, the temperature will raise and then reach the melting point of the fuse metal of the thermal fuse 4 and the fuse metal will form two small dots and then break at the same time, the temperature received by the thermal fuse 4 can accurately reflect the temperature of the thermal device 3 as the thermal fuse 4 is closely attached to the thermal device 3. Hence, the safety of the driving power supply can be effectively improved. Moreover, the thermal fuse 4 not only provides protection for the inputs of the driving power supply, but also provides protection for other main or branch circuits.

Figure 2:
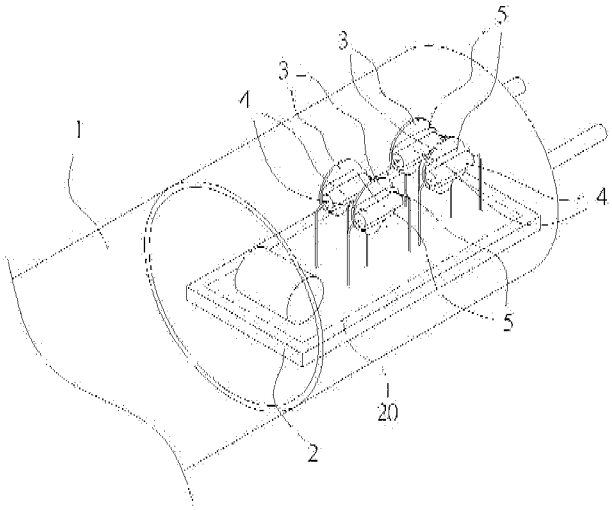
FIG. 2 illustrates a schematic perspective view showing several overheating-protection devices according to one embodiment of the present invention.

Furthermore, in FIG. 2, several thermal fuses 4 are used to be closely attached to the thermal device 3 which may have thermal runaway condition in abnormal situations, and the thermal fuses 4 are serially connected to the electrical circuit 20 of the control circuit board 2. Hence, when the thermal device 3 is warmed up abnormally, the application of the thermal fuses 4 ensures that the thermal fuse 4 is capable of being blown timely to make the electrical circuit 20 disconnected, thereby preventing from the safety hazards.

According to one or more embodiments of the present invention, the protection system has following features. The thermal fuse is attached to the thermal electronic component, thereby increasing the safety of the driving power supply. Moreover, the thermal fuse not only provides protection for the inputs of the driving power supply, but also provides protection for other main or branch circuits.

Although particular embodiments of the invention have been described in detail for purposes of illustration, various modifications and enhancements may be made without departing from the spirit and scope of the invention. Accordingly, the invention is not to be limited except as by the appended claims.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A protection system for a lamp, comprising: a circuit board, at least one thermal electronic component, and a thermal fuse, wherein the circuit board has an electrical circuit and is disposed in the lamp, the thermal electronic component is electrically connected to the electrical circuit of the circuit board via a plurality of connecting elements and supported by the connecting elements, whereby the thermal electronic component is suspended over the circuit board and there is a distance between the thermal electronic component and the circuit board, wherein a binding member is disposed on the thermal electronic component to form an adhesive layer in a middle portion of the thermal electronic component and covering a portion of a surface of the thermal electronic component, wherein a shape of the adhesive layer is corresponding to a shape of the thermal fuse and the binding member is made of phenolic resins, urea-formaldehyde resins, polyvinyl acetate resins, polyethylene-vinyl acetate resins, polyacrylic resins, polyurethane, or hot-melt adhesive, wherein the thermal fuse is disposed on the adhesive layer and adhered to the adhesive layer, whereby the thermal fuse is closely attached to and fixed on the thermal electronic component via the binding member, wherein the thermal fuse is electrically connected to the electrical circuit to ensure that the thermal fuse is capable of being blown timely to make the circuit disconnected after the temperature of the thermal electronic component raises to a blown threshold value of the thermal fuse.

2. The protection system as claimed in claim 1, wherein the protection system comprises a plurality of the thermal fuses disposed on the circuit board and serially connected to the circuit board, and the thermal fuses are electrically connected to the electrical circuit and attached to the thermal electronic component.

3. The protection system as claimed in claim 1, wherein the thermal electronic component is a varistor, a coil, or a transformer.

* * * * *